US005692650A

United States Patent [19]

Wolter et al.

[11] Patent Number: 5,692,650

[45] Date of Patent: Dec. 2, 1997

[54] COMPACT DISPENSER WITH INTEGRAL MOUNTING FLANGE

[75] Inventors: Michael Wolter, Steckborn, Switzerland; Lothar Graf, Rielasingen-Worblingen; Gottfried Fuchs, Steisslingen, both of Germany

[73] Assignee: Ing. Erich Pfeiffer GmbH, Radolfzell, Germany

[21] Appl. No.: 689,573

[22] Filed: Aug. 12, 1996

Related U.S. Application Data

[63] Continuation of Ser. No. 355,915, Dec. 14, 1994, abandoned.

[30] Foreign Application Priority Data

Dec. 15, 1993 [DE] Germany ..... 43 42 680.8

[51] Int. Cl.[6] ..... B67D 5/40

[52] U.S. Cl. ..... 222/321.9; 222/385

[58] Field of Search ..... 222/321.2, 321.7, 222/321.9, 382, 383.1, 385

[56] References Cited

U.S. PATENT DOCUMENTS

| | | | |
|---|---|---|---|
| 3,439,830 | 4/1969 | Hendrickson et al. | 220/27 |
| 4,216,883 | 8/1980 | Tasaki et al. | 222/321.2 |
| 4,821,923 | 4/1989 | Skorka | 222/80 |
| 4,951,842 | 8/1990 | Ruscitti et al. | 222/321.9 |
| 4,984,702 | 1/1991 | Pierpont | 222/321 |
| 5,069,369 | 12/1991 | McGarvey | 222/321.9 |
| 5,224,631 | 7/1993 | Wells et al. | 222/402.1 |
| 5,326,000 | 7/1994 | Fuchs | 222/321.7 |
| 5,335,823 | 8/1994 | Fuchs et al. | 222/36 |
| 5,370,272 | 12/1994 | Gueret | 222/95 |

FOREIGN PATENT DOCUMENTS

| | | |
|---|---|---|
| 571280 | 11/1993 | European Pat. Off. . |
| 653359 | 5/1995 | European Pat. Off. . |
| 2225935 | 11/1974 | France . |
| 2314771 | 1/1977 | France . |
| 2382946 | 10/1978 | France . |
| 2492240 | 4/1982 | France . |
| 2560160 | 8/1985 | France . |
| 1785072 | 1/1959 | Germany . |
| 1911496 | 12/1964 | Germany . |
| 7607195 | 3/1976 | Germany . |
| 2906308 | 8/1980 | Germany . |
| 3118587 | 2/1982 | Germany . |
| 8500025 | 4/1985 | Germany . |
| 3539405 | 5/1987 | Germany . |
| 3545409 | 7/1987 | Germany . |
| 1776245 | 11/1992 | Russian Federation . |
| 513777 | 10/1939 | United Kingdom . |
| 2049826 | 12/1980 | United Kingdom . |
| 2240330 | 7/1991 | United Kingdom . |

*Primary Examiner*—Philippe Derakshani
*Attorney, Agent, or Firm*—Quarles & Brady

[57] ABSTRACT

A discharging apparatus (1) is arranged in substantially completely inserted or plunged manner in a storage vessel (2) with a locking flange (30), which forms an opening (40) for the at least partial reception of the operating head (20) and engages round the vessel neck (7) in the manner of a hang-in profile. The locking flange (30) carries a securing body (50) for the snap retaining of closure cap lid. Thus, there is a very compact arrangement of the discharging apparatus (1) in such a way that the latter only insignificantly increases the total length of the storage vessel (2).

34 Claims, 2 Drawing Sheets

48
46
1
16
58
20
47
54
21
49
17
5
51
10
27
52
53
2
3
4
14
7
19
6
8
23
50
22
18
12
11
15
13
9
26
28
25
24

COMPACT DISPENSER WITH INTEGRAL MOUNTING FLANGE

This is a continuation of application Ser. No. 08/355,915 filed Dec. 14, 1994, now abandoned.

BACKGROUND OF THE INVENTION

The invention relates to a discharging apparatus for media, which in the stored and/or discharge state essentially have random states of aggregation or form a mixture of such aggregation states, which can e.g. be liquid, pasty, gaseous and/or pulverulent and in particular in such a way that they are flowable. Such a discharging apparatus, which can be elongated, is appropriately inserted in said longitudinal direction in one or more openings of one or more storage vessels, as a function of whether only a single medium, separate media from separate storage vessels or separate media charges via separate channels are to be discharged from one storage vessel.

The discharging apparatus then projects with approximately ¾ of the length of its body which is substantially fixed during discharging with respect to the storage vessel into the latter, whereas with the remainder of said length, namely more than ¼ or ⅓ thereof projects over the outside of the storage vessel. To the inner end of the body can also be fitted a suction duct not incorporated into said overall length, e.g. by plugging in or can be constructed in one piece with said body. Said total length is in particular to be determined by the distance between a valve seat of an inlet valve and the outer end face of the body, the said body then projecting over the outside of the vessel by more than ⅓ of said total length.

Thus, compared with the total length of the storage vessel, the complete discharging unit is larger by said amount and by the length of an operating head connected to the outer end of the body, so that there is a significant length difference between such storage vessels, whose opening is to be freed or opened with respect to the media discharge and those which have an additional discharging apparatus with a constricted discharge channel compared with the vessel opening. Such discharging apparatuses can have a pouring connection positionally fixed with respect to the storage vessel, a dosing device for the medium, a pressure source for pressurizing the storage vessel, a naturally aspirated discharge device and/or discharge pump, the inlet valve simultaneously forming the outlet valve of the storage container up to which the medium can flow from the latter without being hindered by further valves or the like. Optionally it is also possible to combine into a subassembly two separate bodies or discharging apparatuses or place them on the same storage vessel, resp. hollow body.

The particular opening of the storage vessel can be formed by a break in a vessel all positioned transversely to the insertion direction, a jacket-shaped vessel neck constricted compared with the vessel bulge and/or one end of a cup-shaped open vessel, which has a substantially constant inside diameter from said optionally slightly widened end roughly up to its bottom. For the engagement or position securing of the discharging apparatus the storage vessel forms reference surfaces with respect to which the discharging apparatus is to be supported. Such reference surfaces can be formed by the surface surrounding the vessel opening on the outside of the storage vessel and/or the inner surface of the vessel opening or the storage vessel, the particular reference surface can be an end face positioned transversely to the longitudinal direction and/or an inner or outer circumferential surface curved round the longitudinal direction.

For positionally securing the discharging apparatus with respect to the storage vessel in the longitudinal direction and/or for securing against rotary movements of the body of the discharging apparatus with respect to the storage vessel fastening means are provided which, after inserting the discharging apparatus are brought into their fastening state and must therefore be accessible from the outside of the assembled unit or engage both on the outside of the discharging apparatus and on the outside of the storage vessel. In the case of a crimp ring the latter must engage round remote sides of ring flanges supported against one another of the body and the storage vessel and also engage round the outer circumference of said ring flanges. In the case of a plug-in or screw cap the latter must engage in positionally secured manner in the outer circumference of a vessel neck and the discharging apparatus must bear against said end faces. Simultaneously the fastening means must be movable for fastening purposes with respect to the body if the latter is not to move or rotate relative to the storage vessel on transferring the fastening means into the fastening state.

OBJECTS OF THE INVENTION

An object of the invention is to provide a discharging apparatus, which avoids the disadvantages of known constructions and which in particular with a simple construction makes it possible to significantly shorten the overall length of the assembled discharging unit.

SUMMARY OF THE INVENTION

According to the invention means are provided through which the discharging apparatus in at least one operating state can be much more deeply plunged in the storage vessel than in known constructions so as to be positionally secured in the longitudinal, transverse and/or circumferential direction or can be retained in substantially positionally rigid manner with respect to the storage vessel. The operating positions can be discharge positions in which a discharge is possible, or can be inoperative positions in which a discharge is prevented, so that for discharge purposes it is initially necessary to transfer into a discharge position.

For example, the body of the discharging apparatus can be so deeply plunged into the storage vessel that it projects over the same with less than ¼ or 1/10 of said total length and between these two values any integral quotient can be advantageous, as a function of the particular requirements. In particular, the body projects over the outside of the storage vessel surrounding the vessel opening by only the thickness of a one-layer or multi-layer wall, whose wall layers are directly engaged with one another and a wall layer can be formed by a seal or packing. This thickness is appropriately below 3 or 2 or 1 mm or corresponds roughly to the wall thickness of one casing or jacket of the discharging apparatus located within the storage vessel.

If the discharging apparatus has an operating head or the like to be displaced e.g. in said longitudinal direction for discharge purposes, then said head in the particular operating position of the discharging apparatus or in at least one of its inoperative or operative positions can project with most of its length over said outside of the storage vessel or into the latter and it is also conceivable for the operating head to be substantially completely plunged within the storage vessel.

The securing means appropriately have means for positive longitudinal supporting of the discharging apparatus with respect to the storage vessel, said supporting means or their support faces being located roughly in the plane of the outer end of the body and/or can be connected thereto, but appropriately the connection is displaced with respect thereto in the longitudinal direction, e.g. towards the inner end of the body. The securing means can be located on the outside and/or inside of the vessel and the latter requires internally no opening, depression or groove for the engagement of the securing means. No vessel widening is required, but in the same way as the depression is also possible.

The securing means can have centering means for the optionally radially pretensioned or radial clearance-free engagement on the inside of the storage vessel, which are appropriately formed by a jacket or shell, which is connected to the body in axially spaced manner from the axially acting supporting means. The centering means can also be provided for engagement on the outside of the storage vessel, said centering means being appropriately less long than the inner centering means or project less towards the inner end of the body than the inner centering means.

Between the inner centering means or a jacket engaging in the vessel opening or the storage vessel and the outer circumference of the body can be formed an opening or depression open towards the outside or towards its outer end and in which can e.g. engage the operating head in at least one of its operating positions. The appropriately tightly closed bottom of this opening is appropriately located within the storage vessel or vessel neck and can simultaneously form the connection between the securing means and the body.

The securing means are advantageously constructed in such a way that they exert no or no significant radial force on the body, so that the latter is not loaded by the radial securing forces. For example, the inner centering means can be free from radial loads through the inner circumference of the storage vessel or radially substantially tension-free in the area in which they are connected to the body. The inner centering means can also be profiled in such a way that any radial loads are not transferred by the storage vessel to the body and instead are so absorbed by elastic flexibility that only the centering means and not the body are deformed. To this end the centering means can form with the body in cross-section a U-profile with a radially outer and a radially inner leg, one of these legs, particularly the outer leg not being continuously linear but instead angled or curved on its inside and/or outside.

If the discharging apparatus has a casing seal separate from a main casing at the outer end or the like and which e.g. forms the outer end of the body, then the securing means can be connected in bearing manner to this casing seal or via the latter in bearing manner to the main casing. Together with the casing seal the securing means appropriately form an assembly unit for fixing to the main casing or form with the main casing an assembly unit for fixing to the storage vessel. In the assembly state the securing means can be provided in substantially positionally fixed manner with respect to the casing seal or casing and can also be constructed integrally therewith.

The securing means are appropriately constructed as plugging means, which substantially exclusively can be brought into their final securing engagement with the storage vessel by a linear plugging movement roughly parallel to the longitudinal direction of the discharging apparatus, instead of requiring a rotary movement over part of a complete rotation or one or more complete rotations. Therefore the securing means can be completely free from threads, bayonet catch members, snap members or similar securing profilings, although the use thereof is conceivable. This also applies for the conical support faces, particularly those for supporting on the inside of the storage vessel or vessel neck, said supporting or centering faces being located in the vicinity of the engagement on the storage vessel roughly parallel to the insertion direction or the opposite face of the storage vessel and with respect thereto are inclined by at the most an angle of less than 1° or 2° such as is conventionally used as a mould removal angle during production in a mould.

Independently of the described construction the discharging apparatus can also have closure means for a substantially tight closure of the vessel opening and which are constructed in the manner described with respect to the securing means. These closure means can engage non-destructively with the securing means in the storage container so as to be detachable by a withdrawal movement or the like, so that together with the discharging apparatus they can be completely removed from the storage container. Appropriately the closure means and securing means are constituted by the same means.

The construction according to the invention is particularly suitable for discharging apparatuses such as are e.g. described in U.S. patent application Ser. No. 940,442 or DE-OS 35 45 409, to which reference should be made for features and effects which are hereby incorporated into the present invention. The discharging apparatus can be plunged so deeply into the storage vessel that the limitation of its inlet opening formed by the body or a riser or a flexible rising tube is directly adjacent to the vessel bottom or is supported on the latter in an area which is countersunk with respect to the remaining bottom areas, so that a complete emptying of the storage vessel is ensured.

Independently of the described construction it is also possible to provide a cover or a non-destructively, easily detachable closure for the discharging .apparatus or its media outlet, which is suitable both for direct connection to the discharging apparatus or the securing or closure means and also for being directly connected to the storage vessel if the latter is not provided with a discharging apparatus. In the covering position the cover is so secured with respect to the discharging apparatus that for this purpose the storage vessel is not required, e.g. in that the cover then exclusively engages in the discharging apparatus or the securing means with position securing faces and can be contact-free with respect to the storage vessel. For the direct closure of a storage vessel the cover appropriately engages over its neck on the outer circumference.

Independently of the described construction an assembly arrangement is also provided for position securing means, which interconnect in easy, non-destructively detachable manner two components. These securing means have two detachably interengaging securing members, whereof one is associated with one component and the other with the other, removable component. These securing members can be mounted in their securing position on one of the components, particularly on the removable component, whereafter said component is fitted to the other component in its securing position. The securing member associated with said other component is engaged with said component and as a result of the assembly movement is secured in position with respect thereto so that on removing the removable component it is not detached from the associated component and instead releases the securing member of the removable component, which ensures a very easy assembly.

BRIEF FIGURE DESCRIPTION

These and further features can be gathered from the claims, description and drawings and the individual features, both singly or in the form of subcombinations, can be implemented in an embodiment of the invention and in other fields and can represent advantageous, protectable constructions for which protection is hereby claimed. An embodiment of the invention is described in greater detail hereinafter relative to the drawings, wherein show:

FIG. 1 A discharging apparatus according to the invention in a part sectional view.

FIG. 2 A detail of FIG. 1 on a larger scale.

DETAILED DESCRIPTION OF A PREFERRED EXAMPLE EMBODIMENT

Figure 1:
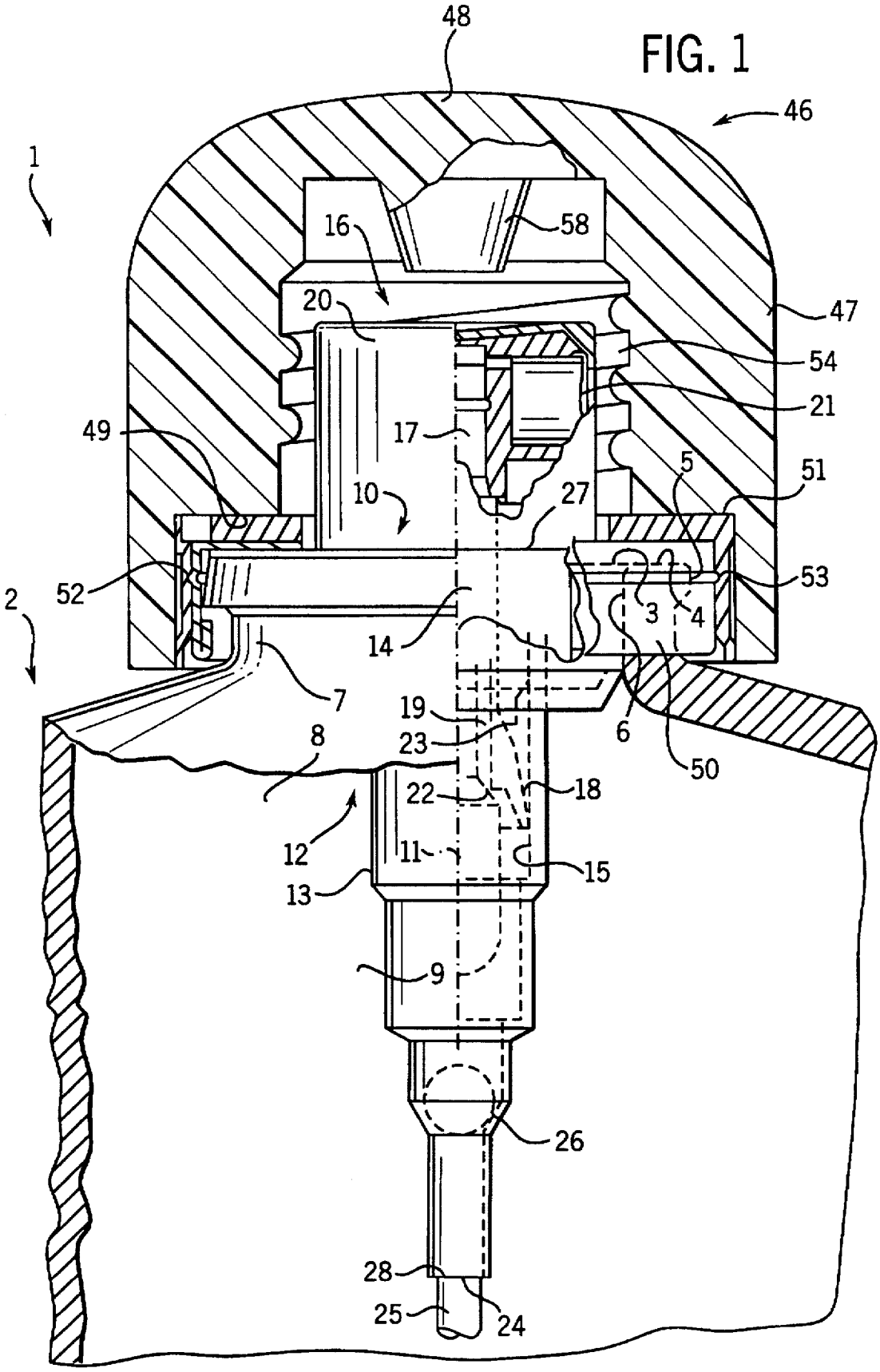
Figure 2:
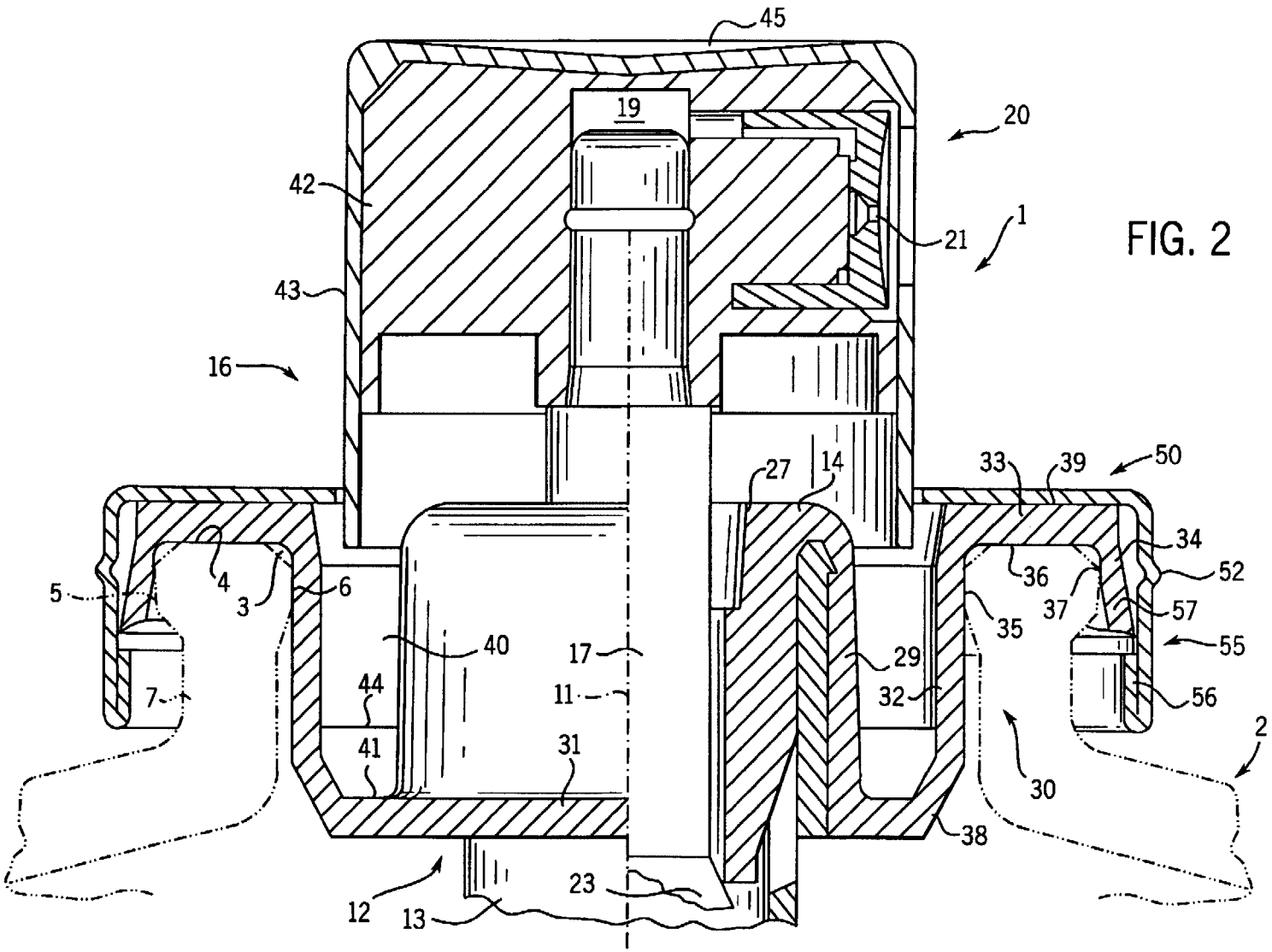

In the manner of a submersible pump the discharging apparatus 1 is substantially completely plunged into a storage vessel in such a way that the pump casing is substantially completely located within the inner space of the storage vessel 2. Said storage vessel 2 has an essentially axially symmetrical, circular vessel opening 3, which on the outside of said vessel 2 is surrounded by an annular outer end face 4 at right angles or transverse to its central axis. In radially spaced manner it is surrounded from the outside by an outer circumferential surface 5, which is formed by a projecting torus and passes directly or via a chamfer or rounding into the end face 4. In the same way the inner circumferential surface 6 bounding the vessel opening 3 passes into the end face 4, said circumferential surface 6 being formed by a radially inwardly projecting torus and being located roughly in the same axial portion as the circumferential surface 5. The vessel opening 3 and the surfaces 4 to 6 are formed by a vessel neck 7, which on its end remote from the opening 3 passes into a substantially widened vessel bulge 8 having roughly the same wall thickness as the vessel neck 7. This bulge 8 bounds with part of the neck 7 the storage space 9 for receiving the medium to be discharged closed to the outside in the starting state in a substantially media-tight or pressure-tight manner. The vessel neck 7 can be very short and have a length of only approximately 2/10 of its outside diameter, the circumferential surfaces 5, 6 being less than half shorter.

For fixing the discharging apparatus 1 securing means 10 are provided, which in the same way as the discharging apparatus 1, the vessel opening 3, the surfaces 4 to 6, the vessel neck 7 and the vessel bulge 8, can roughly be in the central or longitudinal axis 11.

The discharging apparatus 1 has a substantially positionally rigid, hollow body 12 fixed to the associated fixing or fastening portion 7 of the storage vessel 2 and which forms the said casing and is elongated along the longitudinal axis 11, namely at least two to three times longer than its greatest outside diameter. The body 12 is assembled from two body parts, namely a longer casing part 13 and a shorter closure part 14, the casing part 13 projecting over the inner end of the closure part 14 with most of its length or more than 3/4 thereof in contact-free manner into the storage space 9. In spaced manner within the inner end of the closure part 14 the casing part 13 with the inside of its wall outwardly adjacent to the storage space 9 bounds a medium or pressure chamber or space 15, which serves as a pump chamber and in cross-section is at least partly annular.

For the operation of the discharging apparatus in such a way that medium is delivered or discharged, an operating unit 16 is provided which, for manual operation, is partly located outside the body 12 and the storage vessel 2 or is accessible in the vicinity of the vessel opening in manual manner or through the latter. The operating unit 16 has a slender, elongated shaft or shank 17, which at least partly traverses the body 12 or both casing parts 13, 14 and carries within the same a slide 18. The latter, sealed as a pump piston 18, is displaceably guided along the inner circumference of the pressure chamber 15 which it bounds on its front end face. From the pressure chamber 15 an outlet channel or duct 19 leads through the shaft 17 or to the body 12 into an operating head 20, which is fixed to the outer end of the shaft 17 positioned outside the body 12 in removal-prevented manner merely by a linear plug-in and/or notched connection. The operating head 20, which is accessible for manual operation, has the medium outlet 21 leading into the open and which is in this case formed by a nozzle body or atomizer directed radially outwards and completely countersunk in the operating head 20 and which is positioned between the ends of said head 20.

The slide or piston unit formed by the shaft 17, slide 18 and core body inserted therein forms the portion of the outlet channel 19 which is ring-shaped in cross-section and adjacent to the pressure chamber 15 and which is positioned between the inner circumference of the sleeve-like slide 18 and the outer circumference of the core body. In addition, said piston unit forms an outlet valve 22 located within the slide 18 and which as a function of the displacement path of the slide 18 and/or the pressure in the pressure chamber 15 opens in an elastic manner, is formed by an annular closing face on the inner circumference of the slide 18 and a counterface on the outer circumference of the core body and which with said valve closure defines the front end of the pressure chamber 15 or the rear end of the outlet channel 19. By an outwardly directed longitudinal movement of the slide 18 relative to the shaft 17 or the core body fixed thereto the valve opens counter to the tension of a valve spring, so that in the opposite direction it closes again under spring tension.

In the space of the body 12 connected externally to the sealing face of the slide 18 and adjacent to its outer circumference is provided a vent valve 23, which in the starting position of the discharging apparatus 1 is closed in media or pressure-tight manner and is open in any other position, so as to provide through the body 12 or along the shaft 17 a pressure compensation between the storage space 9 and the external atmosphere. The closure part 14 has a sleeve attachment engaging in the interior of the casing part 13 and whose end forms the valve seat, whilst the valve body is formed by the outer circumference of the slide 18. The venting space having the vent valve 29 and sealed with respect to the pressure chamber 15 is open by means of at least one opening in the wall of the casing part 12 to the storage space 9.

Within the storage space 9 the discharging apparatus 1 has a media inlet 24 in the form of an inwardly directed opening in the body 12, which is appropriately formed a front opening. To said inlet can be connected, as a function of the length of the storage space 9, a riser 25, e.g. a flexible or elastic hose, whose end remote from the body 12 then forms the transition point in which the medium enters the discharging apparatus 1 from the storage space 9. Within the body 12 or the casing part 13 is provided a pressure dependent operating inlet valve 26, which is located on the inner end of the pressure chamber 15 or forms said inner end with its valve seat.

The end of the body 12 remote from the outlet 21 and located within the storage space 9 forms its inner end 28, whereas the end remote therefrom forms the outer end 27 and is formed by the free outer face of the closure part 14. Outwards therefore means towards the outlet 21, towards the outer end 27 or towards the vessel opening 3 and inwards means towards the inner end 28, towards the vessel bottom or towards the vessel space 9.

From the inner end the casing part 13 is inserted into the wider outer circumferential closure part 14 within which and with which it is connected by means of a plug-in or snap connection, does not project over the outer end 27 and is surrounded on the outer circumference of its inserted longitudinal portion by an outer jacket 29 of the closure part 14, which also forms the exposed outer circumference of said part 14. This jacket 29 is connected between its ends or following onto its inner end to a securing or locking flange 30, which is frictionally secured or locked against outwardly directed forces and engages in the vessel neck 7 and is supported positively and in clearance-free manner against inwardly directed forces, so that when a correspondingly high removal force is applied, the retaining force of the locking flange 30 is overcome and the discharging apparatus 1 is removed non-destructively from the storage vessel 2. The locking flange 30 cross-sectionally forming a hook or hang-in profile with a locking groove for receiving the vessel neck 7 is approximately rigidly connected to the body 12 in only a single and very short axial area, the length of the latter being significantly smaller than the outer wall of the casing part 14 and at the most two to three times as large as the wall thickness of the jacket 29 or the casing part 13. The closure part 14 has a ring disk-like or planar supporting flange 31 connected to its inner side and which projects over the outer circumference of the jacket 29 not widened compared with the outer end 27 and which has the indicated axial extension, is constructed integrally with the jacket 29 and like the inner end of the remaining closure part 14 is located in completely contact-free manner on its inner end face. The boundary between the body 12 and the locking flange 30 is defined either by the outer circumference of the jacket 29 and/or that of the support flange 31.

To the outer circumference of the support flange 31 is connected a jacket 32 located with a radial spacing from the jacket 29 and surrounding its outer circumference approximately over its entire length and which in the same way as the jacket 29 in axial section forms a leg of a U-profile or a wall part, the jacket 29 being connected to the end wall of the closure part 14 forming the outer end 27 and from whose inside projects the attachment engaging in the casing part and in which is displaceably positioned the shaft 17. The outer end of the jacket 32 passes in radially outwardly directed manner into an angular or hook-shaped part, the jacket 32 being connected to an end part or support flange 33, which forms a wall part or an annular end wall or a substantially planar plate, in which it is located with its inner and/or outer end face in a plane roughly at right angles to the axis 11. The wall thickness of the jacket 32 and the support flange 33 is roughly of the same order of magnitude as the thickness described relative to the flange 31. The support flange 33 forms a hook leg of the angular hook profile and at its radially outer end or at its outer circumference passes into a leg or jacket 34, which projects axially over its inner end face 36, but much less far than the jacket 32, namely less than ½ or ⅓ thereof. The resulting hang-in profile shields the body 12 at the outer circumference and engages round the vessel neck 7 at the inner circumference, at the outer circumference and on the outer end face, all the said wall parts 31 to 34 forming integral, continuous, tightly closed walls and the wall part 34, for obtaining a higher spring resilience, is thinner than at least one of the other wall parts 31, 32, 33.

The wall parts 32 to 34 form at least two or three orientation and protective faces 35 to 37 positioned transversely or approximately at right angles to one another and passing into one another in reentrant angles, whereof at least one is associated with one of the reference surfaces 6, 4, 5 in such a way that it resiliently engages thereon with transverse tension. Of the U-shaped engaging faces the outer circumferential face 35 of the wall part 32 cross-sectionally substantially in whole-surface manner engages on the associated reference surface 6, but is only formed by a relatively small axial portion of said wall part 32 and the associated circumferential surface. The substantially planar, ring disk-like support face 36 engages with most of its surface, whereas the securing face 37 of the wall part 34 formed by the inner circumferential surface only engages on a part of the reference surface 5 connected to the reference surface 4 in a transition phase. The wall part 34 completely covers at the circumference the reference surface 5 and projects axially over said surface 5 towards the storage space 9 with a slightly funnel-shaped widened portion.

At the inner end the wall part 32 contact-free with respect to the vessel 2 passes into a jacket profile 38, namely a conical portion tapering inwardly in acute-angled manner on the inner or outer circumference and which with its narrower end is integrally connected to the support flange 31 and is also contact-free relative to the vessel 2. Thus, in said area the wall part 32 is stiffened with respect to the body 12, which prevents the transfer of radially inwardly directed forces to the body 12. The jacket profile 38 also forms an insertion bevel during the insertion of the locking flange 30, which can slide on a corresponding funnel-shaped widening of the vessel opening 3, the funnel shape being formed by a chamfer between the reference faces 4, 6. The locking face 35 appropriately inwardly approaches the axis 11 over a few radians, so that it only engages with transverse tension in the reference surface 6 when the support flange 31 is located within the latter. Under this tension the wall part 32 can be slightly inwardly radially narrowed, so that by its inherent spring tension only it brings about the seal with respect to the reference surface 6. The reciprocal engagement of the surfaces 4, 36 or 5, 37 also acts in tight sealing manner, so that there is a triple seal in the vicinity of three spaced sealing gaps and the effects of a labyrinth packing are obtained.

The outer surface 39 remote from the support face 36 and removed from the latter only by the wall thickness of the wall part 33 is substantially planar and circular or is located roughly in the plane of the outer end 27, which could also be inwardly displaced with respect to said outer face 39. The inner end face of the support flange 31 is roughly in the plane of the transition between the vessel neck 7 and the associated end wall of the vessel bulge 8, so that the locking flange 30 virtually completely fills the interior of the neck except for a small annular clearance on its inner circumference and the closure part 14 is substantially completely located within the locking flange 30.

However, to the outside parts of the locking flange 30 are open, so that a ring jacket-shaped opening 40 is formed between the faces 27, 39 and the outer end face of the support flange 31, which is bounded by the outer circumference of the jacket 29 and the approximately coaxial inner circumference of the jacket 32. The opening 40 which is roughly two to three times wider than these jackets 29, 32 is widened in funnel-shaped manner slightly towards the outside or at the outer end connected to the outer face 39 and has a closed bottom 41 formed by the support flange 31, so that no medium can pass into the opening 40 from the storage space 9.

The operating head 20 has a plastic body 42 receiving the shaft 17 and the nozzle head, as well as a cap part 43 substantially completely covering the same on the outer circumference and on the outer end and said cap part can be made from plastic or metal and have a much thinner wall than the body 42.

The jacket of the cap part 43 engaging in substantially gap-free manner on the outer circumference of the body 42 projects inwards over the latter and in the starting position projects over the outer circumference of the closure part 14 from the end 27, so that it engages roughly by the thickness of the wall part 33 and roughly in the centre between the wall parts 29, 32 in contact-free manner in the opening 40. In the pressed down pump stroke end position the end of the cap jacket can engage on the edge faces of ribs 44 or the like, which integrally connect the outer circumference of the closure part 14 to the inner circumference of the wall part 32 and extend up to the bottom 41, so that in the vicinity thereof they contribute to the indicated stiffening effect and between the ribs 44 and the support face 36 and consequently in the vicinity of the reference surface 6 the wall part is at its most resilient or most flexible.

The vessel 2 or vessel neck 7 is appropriately made from glass or a material with a much greater stiffness than the locking flange 30, so that the reference surfaces 4 to 6 do not give way under the pressing force of the flange 30 and in the same way as the surfaces 35 to 37 can be constructed as very smooth surfaces, and the particular reference surface 4 to 6 can press slightly into the associated surface 35 to 37. Therefore the locking flange 30 forms a tight plug for the vessel 2.

In the pump stroke or operating end position the outlet 21 is outside the locking flange 30 by a spacing from the outer face 39 which corresponds to two to four times and in particular roughly three times the thickness of the wall part 33, the outlet 21 being oriented roughly parallel to the outer face 33. The operating handle 45 is constituted by the outer face of the end wall of the cap part 43 connected in positionally fixed manner to the body 42 and which in the jacket has, compared with the outlet 21, a significantly widened passage opening for the spray jet to be discharged. In the end position the body 42 can also engage over the closure part 14 on the inner and/or outer circumference or can engage in the closure part 14 and positively strike with an inner face on the outer end 27. The outside diameter of the operating head 20 is larger than its axial extension and in the end position its outer face, outwardly displaced with respect to the outlet 21, is at a distance outside the outer face 39, which corresponds to approximately half the axial extension or outside diameter of the operating head 20. The maximum stroke length of the operating head 20 is about half the length of the locking flange 30, which is smaller than the length of the head 20, so that the stroke is approximately ⅓ of the length of the head 20.

According to the invention, for closing the discharging apparatus 1 when not in use a cap-like cover 46 is provided, which substantially completely receives in covered manner the discharge head 20, the securing means 10, 30 and the neck 7 and in the vicinity of the head 20 has a smaller inside diameter than in the vicinity of the securing means 10. Compared with its end wall 48, the cover 46 has a thicker cap jacket 47 in the vicinity of the operating head 20 and a thinner cap jacket 47 in the vicinity of the securing means 10, in that in its open end is provided an annular depression 49, which as a greater axial extension than the neck 7 or an axial extension corresponding roughly to that explained relative to the locking flange 30.

In the closure state there are two securing bodies 50, 51 completely countersunk or embedded within the depression 49 and whereof one is fixed in stop-limited secured manner to the cover 46 and the other in limited movable manner on the vessel neck 7 or with respect thereto in contact-free manner only on the closure or locking flange 30. The securing body or member 50 is formed by a ring or cup-shaped component made from sheet metal or the like, which has a much thinner wall than the locking flange 30 and engagingly covers the latter with a ring disk-like, planar end wall at the outer face 39. The jacket of the securing member 50 surrounds the outer circumference of the wall part 34 relatively closely and extends approximately up to said end wall of the vessel bulge 8.

The securing body or member 51 is correspondingly ring or cup-shaped, engages with its ring disk-like end wall on the bottom of the depression 49 and extends with its cap jacket to the associated open face of the cover 46, the securing member 51 being positionally fixed e.g. by a resiliently locking snap connection, pressing in, bonding or welding. The end wall of the securing member 51 projects radially inwards over the narrower inner circumference of the cover 46 approximately up to the outer circumference of the operating head 20, so that it forms an annular end boundary of the narrower opening region of the cover 46. With the inner end face of its end wall the securing member 51 engages in large-surface manner on the outer face of the end wall of the securing member 50.

The two securing members 50, 51 engage in easily detachable non-destructive manner in one another by means of a securing member 52 and a countermember 53, which are appropriately constructed as resilient snap members, which can be brought into and out of locking engagement by a reciprocal longitudinal movement and are located roughly in the centre between the ends of the wall part 34. The securing member 52 is followed by a deformation projecting over the outer circumference of the jacket of the securing body 50, such as an annular, closed stiffening corrugation, which need not be radially resilient. The countermember 53 is formed by a corresponding depression or groove on the inner circumference of the jacket of the securing body 51 and is located in an area in which said jacket can be radially resiliently widened compared with the cap jacket 47 without the latter having to perform resilient widening or narrowing movements.

The narrower inner circumference of the cover 46 is provided with a further securing member 54 of the indicated type, e.g. with a snap member, a rotary closure member, such as an internal thread or the like, whose inside diameter is at least as large as that of the opening in the end wall of the securing body 51, so that the securing member 54 with the securing body 51 inserted is protected against damage from the outside and cannot be engaged on a corresponding countermember. If the securing body 51 is removed from the cover 46 or is not fitted from the outset, then the cover 46 can be used for closing a vessel neck or the like, which has on its outer circumference a countermember complimentary to the securing member 54 for the positive, but non-destructive easy detachable connection. Over the inside of the end wall 48 projects in one piece a plug 58 tapered towards its free end on the outer circumference and which in the closed position can sealingly engage in the opening of the vessel neck, so that a very tight closure is obtained.

The securing body 50 is connected by means of a snap connection 55 to the vessel 2 or to the locking flange 30 and is resiliently locked in solely by the axial assembly of the two components 30, 50, so that the securing body 50 is then secured positively or undetachably against removal and can essentially only be removed by destruction. The end of the cap jacket is folded inwards to an inner jacket, which over its entire length engages on the inner circumference of the outer jacket and is directed with its free end face against the end face of the wall part 34. Thus, apart from a double-layer stiffening of the body jacket axially spaced from the securing member 52, said inner jacket forms a snap member 56 located within the same and spaced from the outer circumference of the vessel neck 7 and with respect to its radial extension is substantially shape-rigid.

The second snap member 57 is formed by the free end of the wall parts 34 which is contact-free with respect to the reference surface 4, said end face being inclined in the manner of a barb face or constructed in conically reentrant manner. If the securing body 50 is mounted axially on the outside, exposed areas of the locking flange 30, then the snap member 56 runs up onto the outer circumference of the wall part 34, which is then resiliently radially inwardly pressed until the snap member 57 jumps behind the snap member 56 accompanied by the radial widening of the wall part 34 and consequently the securing body 50 is axially positively secured relative to the vessel 2.

However, the securing body 50 can be rotated relative to the vessel 2 or the locking flange 30, but has substantially no radial clearance with respect thereto. However, the securing body 50 can have an axial clearance in that the snap members 56, 57 are axially spaced from one another when the securing body 50 engages on the outer face 39. If the mounted cover 36 is drawn down, it can raise the securing body 50 up to reciprocal striking of the members 56, 57 from the outer face 39 and only then can the members 52, 53 be disengaged. Thus, the manual unlocking of the cover 46 can be facilitated or the locking force between the members 52, 53 increased. The securing body 50 can be inserted in the cover 46 together with the locking body 51 or after the latter in the locking position and then fitted together with the cap 46 by mounting on the counterflange 30, so that a first mounting of the cover 46 on the counterflange 30 leads to the fitting of the securing body 50 and it can subsequently not be drawn off again.

As a result of the end wall of the securing body 50 projecting over the outer inner circumference of the opening 40 the open end of the opening 40 is covered to close to the outer circumference of the operating head 20, which in turn covers the remaining and further radially inwards area of the open end of the opening 40, so that the latter is only outwardly open in the vicinity of a narrow ring clearance and no dirt can drop in. Any dirt still entering the opening 40 can collect between the ribs 44, so that there is no risk of its effective longitudinal extension being increased by dirt accumulations. The securing body 50 simultaneously forms a protective jacket for the locking flange 30, so that the latter is completely outwardly covered and protected against damage. The locking flange 30, also with the cover 46 fitted, permits a resilient giving way of the discharging apparatus 1 against transverse forces in that the body 12 with respect to the locking flange 30 or the hang-in profile 32, 34 can tilt by a few radians with a rapidly rising spring progression. Said characteristics and arrangements can be provided identically, substantially or approximately in the manner described or diverging therefrom. It is also conceivable to allow the body 12 to project outwards over the plane of the outer face 39 and/or to have the body 12 eccentric to the locking flange 30.

We claim:

1. A dispenser (1) for discharging a medium and for mounting on a vessel body (2) including a vessel opening (3) and reference surfaces (4–6), the reference surfaces 4–6 including an inner circumferential surface (6), an outer circumferential surface (5) and an outer end face (4) when mounted on the vessel body (2) said dispenser (1) defining a mounting position, said dispenser (1) comprising:

a pump casing unit (12) linearly insertable through the vessel opening (3) into the vessel body (2), said pump casing unit (12) having an inner casing end (28) for disposition inside said vessel body (2) and an outer end (27) for disposition proximate to the vessel opening (3), said pump casing unit (12) enveloping an internal casing space, said casing space including a pressure chamber (15) in which the medium is pressurized, said casing space and said pressure chamber being disposed between said inner end (28) and said outer end (27) of said pump casing unit (12) defining an outermost unit circumference;

an operating unit (16) moveable over an operating stroke with respect to said pump casing unit (12) for delivering the medium out of said dispenser (1) through a medium outlet (21); and mounting means (10) defining a mounting axis (11) and including a mounting flange (30), in said mounting position said mounting flange (30) being countersunk in the vessel opening (3) in relation to said outer casing end (27) of said pump casing unit (12), said mounting flange positionally holding said pump casing unit (12) in the vessel body (2) in said countersunk mounting position relative to the outer end face (4), said mounting flange (30) directly supporting and sealing said pump casing unit (12) on at least one of said reference surfaces (4–6).

2. The dispenser according to claim 1, wherein for supporting against the outer end face (4) said pump casing unit (12) and said mounting flange (30) include only a single-layer support flange (33) for directly and sealingly connecting to the outer end face (4), said support flange (33) having an inner flange end face (36) and an outer flange end face (39) defining a flange wall thickness therebetween, said outer casing end (27) defining an outermost end face of said pump casing unit (12), said outer flange end face (39) defining an outermost flange plane of said mounting flange (30), said outermost end face of said outer casing end (27) extending outwards at most to said outermost flange plane (39), said pump casing unit (12) and said mounting flange (30) projecting outwards by substantially at the most 1 to 3 mm over said inner flange end face (36), wherein in said mounting position said pump casing unit (12) is substantially entirely countersunk and immersed in the vessel body (2), said mounting flange (30) providing a vessel seal for sealingly closing the vessel opening (3) when in said mounting position, said mounting flange (30) and said vessel seal being provided by a one-part component.

3. The dispenser according to claim 1, wherein said mounting flange (30) includes a thin bearing flange (31) projecting radially with respect to said pump casing unit (12) and said mounting axis (11), said mounting flange (30) directly connecting to a first support leg (32) oriented substantially parallel to said mounting axis (11), at an axial distance from said bearing flange (31), said mounting flange directly connecting to a radially outwardly projecting second support leg (33), said second support leg (33) directly connecting to a third support leg (34) spacedly opposing said first support leg (32) opposite to said pump casing unit (12), said third support leg (34) axially freely projecting towards said bearing flange (31), said support legs (32–34) including inner sides defining securing faces (35–37) pressing against the reference surfaces (4–6) when said pump casing unit

(12) is in said mounting position, said bearing flange (31) being countersunk with respect to the outer end face (4), said bearing flange (31) being located inside the vessel body (2) when in said mounting position, said bearing flange (31) and at least one of said support legs (32–34) providing a common assembly with said pump casing unit (12), in a pre-assembled state said pump casing unit (12) including a pump casing (13) and a pump casing closure (14) commonly internally receiving said operating unit (16), said pump casing closure (14) including said outer casing end (27), said mounting flange (30) being directly rigidly connected with said pump casing closure (14), said pump casing closure (14) directly bounding said casing space.

4. The dispenser according to claim 3, wherein said first support leg (32) connects in one part to said bearing flange (31) and is radially spaced from said pump casing unit (12), said first support leg (32) providing a jacket body (32) entirely spacedly surrounding said casing pump closure (14), said first and second support legs (32, 33) providing a hook profile for assembly of said pump casing unit (12) with the vessel body (2) in an immersing motion that includes immersion of said bearing flange (31) and said firm support leg (32) through the vessel opening (3), said pump casing closure (14) engaging inside said pump casing (13) and the vessel body (2), said pump casing closure (14) being a one-part component commonly with said second support leg (33).

5. The dispenser according to claim 3, wherein said pump casing unit (12) is located coaxial with said mounting axis (11) and wherein said third support leg (34) freely projects towards said inner casing end (28) and is located radially outside said first support leg (32) with respect to said mounting axis (11), said third support leg (34) including a holding face (37) facing opposite said mounting axis (11) and providing for engagement with the outer circumferential surface (5) of the vessel body (2), said pump casing closure (14) being provided by a component separate from said pump casing (13), said pump casing closure (14) engaging inside said pump casing (13), said pump casing closure (14) defining an outermost circumference of said pump casing unit (12), said mounting flange (30) being entirely a one-part component commonly with said pump casing closure (14).

6. The dispenser according to claim 5, wherein said first support leg (32) and said third support leg (34) are interconnected by a second support leg (33), in cross-section said second support leg (33) providing inner and outer flange end faces (36, 39), at least one of said inner and outer flange end faces (36, 39) being substantially planar, one of said inner and outer flange end faces (36, 39) including a radial holding face (36, 39) for axially supporting said pump casing unit (12) against the outer end face (4) of the vessel body (2).

7. The dispenser according to claim 5, said operating unit further comprising an actuating unit (16) which is assembled with said pump casing unit (12) and further comprising a valve (23) that is operable to open and close in response to operation of said actuating unit (16), said valve (23) including a valve seat, said valve seat being provided by said casing closure (14) in a form of a projection inside said pump casing (13).

8. The dispenser according to claim 3, wherein said securing faces (35–37) are substantially uniformly annularly distributed about said mounting axis (11), and wherein said first, second and third support legs (32–34) include a substantially planar and annular support flange (33) having an outer and an inner flange circumference, said support flange (33) including an outermost flange end face (39) of said mounting flange (30), said outermost flange end face (39) defining an outermost flange end plane (39) of said mounting flange (30), said outer casing end (27) defining an outermost end (27) of said pump casing unit (12) and extending outwards at the most to said outermost flange end plane (39), said annular supporting flange (33) being provided for direct sealing support against the outer end face (4) of the vessel body (2).

9. The dispenser according to claim 1, wherein said dispenser (1) defines an initial operating state, said mounting means (10) providing at least one support leg (32–34) including a first support leg (32) disposed inside the vessel body (2) for direct support against the vessel body (2), in said initial operating state said at least one support leg (32) being spaced from and free of structures that are separate from said support leg (32), said pump casing unit (12) including a pump casing member (14) directly bounding said casing space, and said pump casing member (14) having an outer casing circumference, said first support leg (32) connecting in one part to said outer casing circumference and being circumferentially spaced from said outer casing circumference, said vessel body (2) including a hollow space (9) and said at least one pump casing member (14) including a casing wall having an outer surface that bounds said hollow space (9), said casing wall also having an inside surface directly bounding said pressure chamber (15).

10. The dispenser according to claim 9, said operating unit (16) further comprising an operating head (20) with a head jacket (43) freely projecting towards said inner casing end (28) and spacedly enveloping an operating stem (17), said head jacket (43) displaceably engaging inside a reception opening (40) of said mounting flange (30).

11. The dispenser according to claim 1, wherein said mounting flange (30) includes a support flange (33) for axial and positive support against the outer end face (4) of the vessel body (2), said support flange (33) being connected to said pump casing unit (12) at a connecting zone (31) axially spaced from said support flange (33) and offset with respect to said support flange (33) towards said inner casing end (28), said actuating unit (16) for operating discharge of the medium including a manually accessible operating head (20) manually axially displaceable with respect to said pump casing unit (12), said mounting flange (30) internally receiving said operating head (20) in at least one operating position at least partly inside the inner circumferential surface (6) of the vessel body (2), said pump casing unit (12) including a pump casing member (14) having an outer casing face and an inner casing face made in one part with said outer casing face, said support flange (33) being integrally connected to said pump casing member (14), said pump casing member (14) bounding said casing space.

12. The dispenser according to claim 1, wherein the outer circumferential surface (5) defines a height extension, said actuating unit (16) including an operating head (20) and an operating stem (17) for manual operation to discharge the medium, said outer circumferential surface (5) surrounding reception opening (40) in which said mounting flange (30) is received, said operating head (20) including a radially widened section of said operating stem (17) which extends inside said pump casing unit (12), in at least one operating position said operating head engaging inside said reception opening (40), said reception opening (40) being bounded by a support leg (32) facing and contacting the outer circumferential surface (5), said pump casing unit (12) including a pump casing (13), said pump casing unit (12) including a pump casing closure (14) that defines an outermost radial extent of said outermost unit circumference of said pump casing unit (12), said outermost unit circumference directly bounding said reception opening (40).

13. The dispenser according to claim 1, wherein said mounting flange (30) includes at least one support leg (32–34) including position securing faces (35–37) for directly engaging the reference surfaces (4–6) of the vessel body (2), said pump casing unit (12) including a pump casing member (14) and being at least partly countersunk in the vessel body (2) when in said mounting position, said at least one support leg (32–34) connecting to said pump casing unit (12) in a connecting zone (31) that is axially spaced from and axially offset with respect to at least one of said position securing faces (35–37), said at least one support leg (32–34) being integrally connected to said pump casing member (14) to mount said pump casing unit (12) on the vessel body (2), said pump casing member (14) bounding said casing space axially spaced from said pressure chamber (15).

14. The dispenser according to claim 13, wherein said at least one support leg (32–34) is resiliently displaceable with respect to said pump casing unit (12) in at least one of a longitudinal direction and a radial direction, said pump casing unit (12) including a pump casing (13) with a wall having an inside surface bounding said pressure chamber (15), said support flange (30) connecting to said wall, said pump casing member closing said casing space at said outer casing end and being traversed by said operating unit (16).

15. The dispenser according to claim 13, wherein said pump casing member (14) defines a second casing member and is preassembled with a first casing member (13) both directly and commonly bounding said casing space and rigidly interconnected, only said second casing member (14) directly connecting to said at least one support leg including first, second and third support legs (32–34) interconnecting at angles, said first and second casing members (13, 14) providing separate components that are directly interconnected and positionally stable, said casing space including said pressure chamber (15), said second casing member (14) defining an outermost circumference of said pump casing unit (12) and being made in one part with said first support leg (32).

16. The dispenser according to claim 15, wherein said first casing member (13) has an open end and is oblong for circumferentially directly bounding said pressure chamber (15), said second casing member (14) providing an end cap (14) closing said first casing member (13) at said open end and engaging inside said open end, said end cap (14) bounding said casing space and being traversed by said operating unit (16).

17. The dispenser according to claim 15, wherein said second casing member (14) includes an external connecting flange (31) longitudinally spaced from said casing outer end (27) towards said inner casing end (28), on a radially outer flange end said connecting flange (31) connecting at an angle to said first support leg (32) extending from said connecting flange (31) towards said outer casing end (27), said connecting flange (31) and at least one of said support legs (32–34) being made in part with said second casing member (14), said first casing member (13) being entirely spaced from said outer casing end (27).

18. The dispenser according to claim 1, wherein said mounting means (10) are provided to positionally hold said pump casing unit (12) against gravitational outward motion out of the vessel body (2) by substantially only frictional clamping engagement with the reference surfaces (4–6), said clamping engagement being free of snap connections and providing a radial centering of said mounting flange (30), said centering being substantially free of any radial motion play, thereby said mounting means (10) permitting disassembling of said pump casing unit (12) from the vessel body (2) without destruction and with substantially only axial removal stresses, said pump casing unit (12) connecting to said mounting flange (30) in a connecting zone (31) defining a radially outermost zone edge face and remote zone end faces connecting to said outermost zone edge face, in an assembled state at least one of said zone edge face and said zone end faces being entirely free of contact with the vessel body (2).

19. The dispenser according to claim 1, wherein said mounting flange (30) includes an annular sealing cap (30) for sealingly and overpressure-tightly closing the vessel opening (3), said sealing cap including a cap jacket (32) and enclosing an annular cap space (40) radially internally bounded by said outermost unit circumference and radially externally bounded by said cap jacket (32) having an external jacket circumference remote from said cap space (40) and connecting to said outermost unit circumference in a connecting zone (31), said cap jacket (32) extending from said connecting zone (31) in a direction away from said inner casing end (28), said external jacket circumference including a position securing face (35) for engaging the inner circumferential surface (6) of the vessel body (2), said cap jacket (32) connecting in one-part to a casing member (14) of said pump casing unit (12), said outermost unit circumference and said cap jacket (32) being interconnected by stiffening ribs (44) .

20. The dispenser according to claim 3, wherein at least one of said first, second and third support legs (32–34) is radially resiliently deformable, thereby said at least one support leg (32–34) being positionally adaptable to at least one of the reference surfaces (4–6) of the vessel body (2) under pressure in at least one of an axial direction and a radial direction, said at least one support leg (32–34) being made in one part with said casing closure (14).

21. The dispenser according to claim 19, wherein said connecting zone (31) has an annular bottom wall (31) outwardly projecting over and directly from said outermost unit circumference, said mounting means (10) being provided for locating said annular bottom wall (31) substantially entirely inside the vessel body (2) and the vessel opening (3).

22. The dispenser according to claim 1, wherein said mounting flange (30) includes a closure (30) for closing the body opening (3) of the vessel body (2) around said pump casing unit (12), said pump casing unit (12), said closure (30) providing a first end wall (31) and a second end wall (33) that is wider than said first end wall (31) and that is axially spaced from said first end wall (31), said first end wall (31) including an inner wall circumference, said inner wall circumference rigidly connecting to said outermost unit circumference of said pump casing unit (12), a support leg (32) being provided and connecting said first end wall (31) with said second end wall (33), said support leg (32) being remote from said outermost unit circumference of said pump casing unit (12), said support leg providing a face (35) for directly opposing the inner circumferential surface (6) of the vessel body (2), said pump casing unit (12) including a pump casing (13) and a pump casing closure (14) rigidly connected to said pump casing (13), said pump casing (13) and said pump casing closure (14) commonly bounding said casing space including said pressure chamber (15), said pump casing closure (14) defining said outer casing end (27), said first and second end wall (31, 33) and said support leg (32) being made in one part with said pump casing closure (14).

23. The dispenser according to claim 1, wherein in longitudinal cross-section said mounting flange (30) includes an S-shaped structure having oppositely projecting first and second end legs (29, 34), said first end leg (29) being provided by a body wall of said pump casing unit (12) and connecting to said pump casing unit (12) only at a distance from said inner casing end (28), said S-shaped structure including an outer end wall (33) including a radially outer wall end and a radially inner wall end, said second end leg (34) freely projecting from said outer wall end in an axial direction towards said inner casing end (28) and a support leg (32) projecting from said inner wall end in a same said axial direction, said support leg (32) interconnecting said end legs (29, 34), said pump casing unit (12) including a pump casing (13) and a pump casing closure (14) rigidly connected to said pump casing (13), said pump casing (13) and said pump casing closure (14) commonly bounding said casing space including said pressure chamber (15), said pump casing closure (14) defining said outer casing end (27), said first and second end legs (29, 34) being made in one part with said pump casing closure (14) snap-fitted to said pump casing (13).

24. A dispenser for discharging a medium comprising:

a vessel body (2) including an opening (3) for receiving and storing a medium;

a pump casing unit (12) axially inserted through the body opening (3) into the vessel body (2) and rigidly connected to said vessel body (2) in a mounting position, said pump casing unit (12) internally defining a casing space including a pressure chamber (15) for pressurizing the media;

an actuating unit (16) displaceable over an operating stroke with respect to said pump casing unit (12) for delivering the medium out of said dispenser (1) through a media outlet (21), when in said mounting position said actuating unit (16) being manually accessible from outside the vessel body (2);

mounting means (10) including a mounting flange (30) for positionally holding said dispenser (1) relative to said vessel body (2) when in said mounting position, and a cover (46) for covering said mounting flange (30) outside the vessel body (2), said actuating unit (16) and said vessel body (2) when mounted in a first covering state, said cover (46) being removable from said first covering state and returnable back to said first covering state without destruction, wherein said cover (46) includes a first holding member (51) for positionally securing said cover (46) with respect to said pump casing unit (12) in said first covering state, said cover (46) including a second holding member (54) apart from said first holding member (51) for positionally securing said cover in a second covering state separate from said first covering state, thereby providing holding means for alternately positionally securing said cover (46) either with said first holding member (51) or with said second holding member (54).

25. The dispenser according to claim 24, wherein said second holding member (54) is provided inside said cover (46) and at least one of axially displaced and radially displaced relative to said first holding member (51), said second holding member (54) being radially narrower than said first holding member (51), in said first covering state said second holding member (54) being free of holding engagement and in said second covering state said first holding member (51) being free of holding engagement.

26. The dispenser according to claim 24, wherein said cover (46) has an external cap body (47), at least one of said first and second holding members (51, 54) being provided by a holding body (51, 54) separate from said cap body (47) and fixedly inserted inside said cap body (47).

27. The dispenser according to claim 24, wherein a protection shield is provided for protecting said second holding member (54) against damage in said first covering state, with respect to said second holding member (54), said protection shield being displaceable from a shielding state to a non-shielding state.

28. The dispenser according to claim 24, wherein said mounting means (10) include a countermember (52) for releasably engaging said first holding member (51) in said first covering state, countermember (52) being axially movable against braking friction between two stop-limited end positions with respect to said mounting flange (30).

29. The dispenser according to claim 28, wherein said mounting flange (30) engages the vessel body (2) and a counter body (50) including said countermember (52), said counter body (50) being a component separate from said mounting flange (30), commonly with said counterbody (50) said cover (46) providing a preassembled subassembly for common assembly with said dispenser (1), retaining means (55) being provided for assemblingly retaining said counterbody (50) on said dispenser (1) upon removing said cover (46) after said common assembly.

30. The dispenser according to claim 24, wherein said first and second holding members (51, 54) include at least one of a snap member (53) and a thread member (54).

31. A dispenser (1) for connection to a container (2) for discharging a medium out of the container (2) when in a mounting position, the container (2) including a container opening (3) and a storage space (9) for the medium, said dispenser (1) comprising:

a pump casing unit (12) including a pump casing (13) and a casing closure (14), said pump casing (13) and said casing closure (14) commonly directly bounding a hollow casing interior including a pressure chamber (15) for pressurizing the media, said pump casing unit (12) defining a longitudinally outermost casing end (27) and an inner casing end (28) remote from said outermost casing end (27), said inner casing end (28) being provided for receiving the medium from the storage-space (9), an actuating unit (16) operationally displaceable with respect to said pump casing (12) for actuating discharge of the medium through a medium outlet (21), and a mounting flange (30) for connecting said pump casing (12) to the container (2), said mounting flange (30) including at least one support leg (32–34) for direct support and sealing engagement with the container (2), said at least one support leg (32–34) being made in one part with said casing closure (14), wherein means are provided for substantially entirely immersing said pump casing unit (12) inside the container (2) when in said mounting position.

32. The dispenser according to claim 31, wherein said at least one support leg (32–34) includes a first support leg (33), said first support leg (33) being an annular disk including an outermost disk end face (39) and an inner end face (36) remote from said outermost disk and face (39), said inner end face (36) being provided for said direct sealing engagement, said outermost end face (39) defining an outermost end plane of said mounting flange (30), said outermost casing end (27) reaching at the most to said outermost end plane.

33. The dispenser according to claim 31, wherein between said outermost casing end (27) and said inner casing end (28) said casing closure (14) defines an outermost casing circumference directly bounding a reception opening (40), said actuating unit (16) including an actuating head (20) for manually operating said actuating unit (16), said actuating head (20) projecting inside said reception opening (40).

34. The dispenser according to claim 31, wherein said casing closure (14) is provided by a component separate from said pump casing (13), said casing closure (14) being made in one part with said mounting flange (30) and projecting inside said pump casing (13), said pump casing (13) and said casing closure (14) being rigidly interconnected, said casing closure (14) being traversed by said actuating unit (16), said casing closure (14) providing said outermost casing end (27).

* * * * *